US007656363B2

(12) United States Patent
Devicque et al.

(10) Patent No.: US 7,656,363 B2
(45) Date of Patent: Feb. 2, 2010

(54) RADIO COMMUNICATION ANTENNA FITTED WITH A RADOME AND METHOD OF ASSEMBLING THIS KIND OF RADIO COMMUNICATION ANTENNA FITTED WITH A RADOME

(75) Inventors: Michel Devicque, Guerande (FR); François Golias, Saint Nazaire (FR); Yves Gourhand, Montoir de Bretagne (FR); Pascal Pichon, Pornichet (FR)

(73) Assignee: Alcatel Lucent, Paris (FR)

( * ) Notice: Subject to any disclaimer, the term of this patent is extended or adjusted under 35 U.S.C. 154(b) by 220 days.

(21) Appl. No.: 11/566,951

(22) Filed: Dec. 5, 2006

(65) Prior Publication Data

US 2007/0182659 A1 Aug. 9, 2007

(30) Foreign Application Priority Data

Dec. 6, 2005 (FR) ..... 05 53744

(51) Int. Cl.
*H01Q 1/42* (2006.01)

(52) U.S. Cl. ..... 343/872; 343/840

(58) Field of Classification Search ..... 343/872, 343/840, 912

See application file for complete search history.

(56) References Cited

U.S. PATENT DOCUMENTS

| | | | | |
|---|---|---|---|---|
| 4,786,915 | A * | 11/1988 | Cartwright et al. | 343/909 |
| 4,918,459 | A | 4/1990 | De Teso et al. | |
| 5,528,253 | A | 6/1996 | Franklin et al. | |
| 5,877,730 | A * | 3/1999 | Foster | 343/840 |
| 6,714,167 | B1 * | 3/2004 | Gusick, Jr. | 343/872 |
| 7,138,958 | B2 * | 11/2006 | Syed et al. | 343/872 |
| 7,161,553 | B2 * | 1/2007 | Courtney | 343/872 |
| 7,215,300 | B1 * | 5/2007 | Reid, Jr. | 343/872 |

FOREIGN PATENT DOCUMENTS

| | | |
|---|---|---|
| EP | 1 134 838 A1 | 9/2001 |
| JP | 61-26304 | 2/1986 |
| WO | WO 01/15268 A1 | 3/2001 |

* cited by examiner

*Primary Examiner*—Tan Ho
(74) *Attorney, Agent, or Firm*—Fay Sharpe LLP

(57) ABSTRACT

The present invention concerns a radio communication antenna comprising a reflector fitted to a first opening of a cylindrical lateral screen and a radome formed by a flexible material covering a second opening of this lateral screen so as to have a protective surface facing the reflector. According to the invention, this kind of antenna is characterized in that the protective surface is curved by the mechanical action of a deformation element of the antenna coming into contact with this protective surface.

13 Claims, 1 Drawing Sheet

RADIO COMMUNICATION ANTENNA FITTED WITH A RADOME AND METHOD OF ASSEMBLING THIS KIND OF RADIO COMMUNICATION ANTENNA FITTED WITH A RADOME

CROSS-REFERENCE TO RELATED APPLICATIONS

This application is based on French Patent Application No. FR 0553744 filed on Dec. 16, 2005, the disclosure of which is hereby incorporated by reference thereto in its entirety, and the priority of which is hereby claimed under 35 U.S.C. §119.

BACKGROUND OF THE INVENTION

1. Field of the Invention

The present invention concerns a radio communication antenna fitted with a radome and a method of assembling this kind of radio communication antenna fitted with a radome.

2. Description of the Prior Art

An antenna 10 (FIG. 1*a*) may comprise a main reflector 12 having a concave side the shape of a paraboloid of revolution about an axis 14 of symmetry of the antenna 10, for example, and a feeder device 16 transmitting the electromagnetic waves transmitted or received by the antenna 10.

To improve the performance of an antenna 10 of this kind, it is known to provide the latter with a cylindrical wall 17, hereinafter called the screen 17. This kind of screen 17 in particular limits lateral radiation from the antenna 10 and thereby improves its performance.

The presence of the screen 17 increases the windage of the antenna 10 and the risk of accumulation of elements such as water, dust or snow in the antenna 10. Also, it is known to fit the screen 17 a radome 18 that has a plane protective surface 19 partitioning the space defined by the reflector 12 and the screen 17 from elements external to the antenna.

The radome 18 consists of a flexible material, for example canvas, which has the advantage of requiring a limited production cost, of having a small overall size when packaged prior to its installation on the antenna—because the radome can be fully or partly folded before it is used—and of being sufficiently transparent to the waves transmitted by the antenna over a bandwidth covering different radio communication applications so that the same canvas may be used to fabricate different radomes for different antennas.

However, the presence of the protective surface 19 of the radome 18 facing the reflector 12 may reduce the performance of the antenna 10. Considering a transmit antenna 10, for example, it is apparent that waves reflected by the protective surface 19 disturb the operation of the antenna 10, these reflected waves being represented by arrows in FIGS. 1*a*, 1*b* and 1*c*.

To limit this disturbance, it is known to incline the protective surface 19 of a radome $\mathbf{18}_s$ relative to the axis 14 of the antenna, as shown in FIG. 1*b*. This inclination being known as the 'tilt', an antenna having a radome the plane whereof is inclined in this way is referred to as a tilted radome hereinafter.

In a tilted antenna, a phase shift is introduced between the reflected waves such that the disturbances generated by the reflected waves cannot be added to each other and the average noise caused by these reflected waves is reduced compared to a non-tilted antenna.

However, a flexible and tilted radome $\mathbf{18}_s$ of this kind has drawbacks linked to a relative fragility and to the equipments necessary for assembling it to the screen 17, in particular for tensioning it and maintaining it tensioned with the aid of self-tensioning members such as springs—not shown.

Finally, a tilted flexible radome $\mathbf{18}_s$ is asymmetrical with respect to the axis 14 of the antenna. It is then necessary to take into account a specific orientation of the flexible radome $\mathbf{18}_s$ when assembling it to the screen 17 and when assembling the screen 17, fitted with the radome $\mathbf{18}_s$ to the antenna, this specific orientation being liable to generate assembly errors.

This is why rigid radomes like the rigid radome $\mathbf{18}_r$ from FIG. 1*c* have been developed, this rigid radome $\mathbf{18}_r$ having a protective surface 19 that is symmetrical with respect to the axis 14 of the antenna.

Thus a rigid radome $\mathbf{18}_r$ of this kind may be fitted to a screen without considering the problem of the orientation of the radome relative to the axis of the antenna.

Moreover, using rigid radomes makes it easy to envisage the use of radomes that are concave or convex relative to the internal cavity of the antenna, such shapes possibly being desirable in particular to reduce the windage of the antenna.

Moreover, these rigid radomes have a high resistance to external elements such as rain, wind or snow.

SUMMARY OF THE INVENTION

The present invention results from the observation that, despite their many advantages, rigid radomes have drawbacks that are directly proportional to their dimensions.

Thus the weight and the overall size of a rigid radome are high compared to a flexible radome, generally consisting of a lightweight material that can be folded or stacked. Because of this, the fabrication, packaging and storage of rigid radomes prior to their assembly to an antenna are complex and costly.

Moreover, producing a radome having a homogeneous thickness becomes increasingly difficult as the size of the radome increases.

Furthermore, determining the thickness of the material used in a rigid radome is also a problem as that thickness is determined as a function of the band of frequencies used by the antenna. For example, the thickness of a rigid radome used on an antenna transmitting at a wavelength of the order of 40 GHz is practically twice the thickness of a rigid radome of the same kind used on an antenna transmitting at a wavelength of the order of 20 GHz.

The present invention aims to remove at least some of the drawbacks mentioned above. It concerns a radio communication antenna comprising a reflector fitted to a first opening of a cylindrical lateral screen and a radome formed by a flexible material covering a second opening of this lateral screen so as to have a protective surface facing the reflector, which protective surface is curved by the mechanical action of a deformation element of the antenna coming into contact with this protective surface.

This kind of antenna, fitted with a flexible radome, can combine advantages specific to the use of flexible and rigid radomes without having their various drawbacks.

In fact, an antenna according to the invention has advantages specific to the use of a flexible radome, namely a limited overall size of the radome prior to use—because the flexible radome can be folded—and the compatibility of the same radome with antennas operating in different bands of wavelengths, which reduces the number of radomes to be supplied to a production line assembling such antennas.

An antenna according to the invention is of low cost, given the generally lower cost of a flexible material compared to a rigid material.

Moreover, an antenna according to the invention may use a flexible radome without any means for maintaining its protective surface under tension, which limits the number of parts used in the antenna and consequently the cost of the antenna.

Moreover, an antenna according to the invention has a curved, i.e. a non-plane, protective surface, which reduces the windage of the antenna, one of the advantages of rigid radomes.

In one embodiment, the protective surface is curved symmetrically with respect to an axis of symmetry of the reflector. In this case, the flexible radome has an advantage that is specific to a rigid radome thanks to its axis of symmetry, which facilitates assembly of the antenna by eliminating the need to take account of the asymmetry specific to the flexible radome of a tilted antenna.

In one embodiment, the mechanical action is exerted by at least one of the following elements: a rod, a stay or a spring. This kind of diversity of mechanical elements means that different antennas may be envisaged as a function of the costs and the adaptations appropriate to the use of the antenna.

In one embodiment, the deformation element comprises a deformable rod fixed at both ends to the interior of the cylindrical lateral screen, the length of the rod being greater than the diameter of the cylinder so that the rod remains curved. This embodiment deforms the radome using an element of particularly low cost.

In one embodiment, the deformation element curves the protective surface by applying a traction force to at least one anchor point on the protective surface. This embodiment produces a radome curved towards the reflector.

In one embodiment, the deformation element curves the protective surface by applying pressure to at least one bearing point on the protective surface, thus producing a radome curved towards the exterior of the antenna.

In one embodiment, the deformation element comprises a fixing to a feeder device of the antenna, this arrangement reducing the adaptations necessary for the use of the deformation element.

In one embodiment, the deformation element comprises at least one arm one end whereof is fixed to a waveguide and the other end whereof comes into contact with the protective surface, the arm extending collinearly with an axis of symmetry of the reflector to limit the disturbance caused by the deformation element.

In one embodiment, the protective surface includes rigid portions, which makes the radome stronger, at the same time as enabling it to deform by virtue of its flexible portion(s).

Finally, the invention also concerns a method of assembling a radio communication antenna comprising a reflector fitted to a first opening of a cylindrical lateral screen and a radome formed by a flexible material covering a second opening of this lateral screen so as to have a protective surface facing the reflector, which method comprises the step of assembling the antenna so that the protective surface is curved by the mechanical action of a deformation element of the antenna coming into contact with this protective surface.

This kind of method may be executed quickly and simply thanks to the flexibility of the radome and its ease of storage.

In one embodiment, the method further comprises the step of symmetrically curving the protective surface relative to an axis of symmetry of the reflector, which simplifies assembly as there is no need to take into account a specific orientation of the radome.

In one embodiment, the method further comprises the step of choosing the deformation element from: a rod, a stay or a spring, these elements being simple to use and low in cost.

In one embodiment, the method further comprises the step of fixing a deformable rod to the inside of the lateral screen, the length of the rod being greater than the diameter of the screen so that the rod remains curved.

Other features and advantages of the invention will become apparent in the light of the following description of embodiments of the invention, given by way of illustrative and non-limiting example and referring to the appended figures.

BRIEF DESCRIPTION OF THE DRAWING

In FIGS. 2*a*, 2*b*, 2*c*, 2*d* and 2*e* described hereinafter, elements of the same kind are identified by the same reference.

Figure 1A:
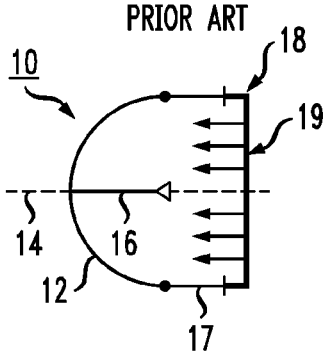
FIG. 1a PRIOR ART
FIGS. 1*a*, 1*b* and 1*c*, already described, are views in section of antennas fitted with prior art radomes.
Figure 1B:
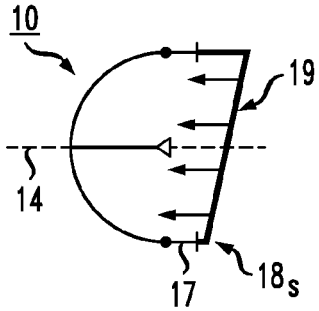
FIG. 1b PRIOR ART
Figure 1C:
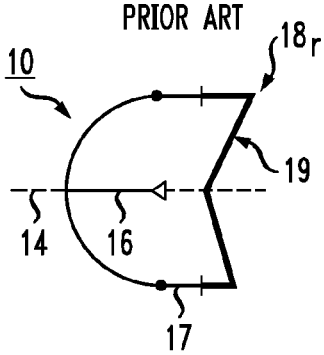
FIG. 1c PRIOR ART

These figures show an antenna 10 according to the invention, i.e. fitted with a reflector 22, a lateral screen 27 fitted to the reflector 22, and a radome 28 partitioning the space between the reflector 22 and the lateral screen 27 with the aid of a protective surface 29 facing the reflector 22.

To this end, the reflector 22 is fitted to a first opening of the cylindrical lateral screen 27 and the radome 28 covers the second opening of that lateral screen 27, the openings of the radome being formed in these embodiments by the circular bases of the cylinder formed by the screen.

According to the invention, the protective surface 29 comprises a flexible material and this surface 29 remains curved because a deformation element exerts an action on the protective surface, the nature of this deformation element varying as a function of the embodiments of the invention described hereinafter.

Figure 2A:
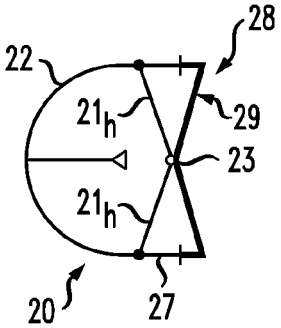
FIGS. 2*a*, 2*b*, 2*c*, 2*d* and 2*e* are views in section of antennas fitted with radomes according to the invention.

In a first embodiment (FIG. 2*a*), the deformation element consists of two stays $\mathbf{21}_h$ that are fixed at one end to the lateral screen 27 and at their second end to an anchor point of the radome 28, such as a ring 23.

The stays can therefore be tensioned to exert a mechanical action on the ring 23 and consequently on the radome 28 the protective surface 29 whereof is more or less curved as a function of the tension exerted by the stay $\mathbf{21}_h$.

This embodiment has numerous variants in which rods or springs are substituted for the stays $\mathbf{21}_h$ and the position and number of these deformation elements, which may be rigid or semi-rigid, vary.

In another variant, not shown, the stays $\mathbf{21}_h$ are replaced by rigid elements the length whereof is such that they cause the protective surface 29 to curve towards the exterior of the antenna 20 by exerting pressure on pressure points thereon.

Figure 3:
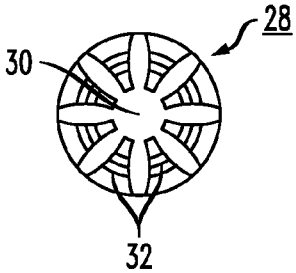
FIG. 3 is a front view of the protective surface of a radome according to the invention.

It should be noted that the protective surface 29 of the radome can equally well either consist entirely of a flexible material, i.e. one able to deform, or comprise rigid portions associated with flexible portions, as shown in FIG. 3, the resulting radome nevertheless being flexible.

FIG. 3 represents the protective surface of a radome 28 according to the invention as seen from the front, showing rigid portions 32 of the radome associated with a flexible portion 30 of the same radome, this combination of rigid portions 32 with a flexible portion 30 producing a flexible, i.e. deformable, radome 28 that is stronger than an entirely flexible radome.

Figure 2B:
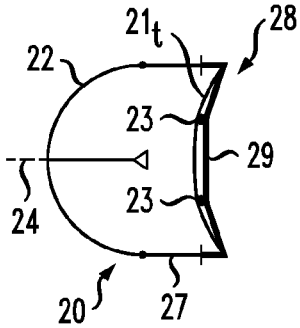

A second embodiment of an antenna according to the invention is shown in FIG. 2*b*. The protective surface 29 of the radome 28 is deformed with the aid of a rod $\mathbf{21}_t$ accommodated in the cavity formed by the reflector 22, the screen 27 and the protective surface 29.

To this end, the rod $\mathbf{21}_t$ is placed perpendicularly to the axis 24 of the antenna 20, being accommodated in diametrically opposed cavities of the screen 27. However, the length of the rod $\mathbf{21}_t$ is greater than the diameter of the screen with the result that the rod remains curved in the cavity. Thus the rod remains bent because of the high mechanical compression stress on it.

Figure 4:
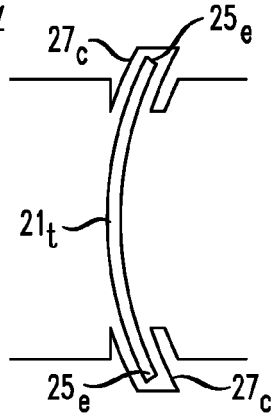
FIG. 4 is a detailed view of one embodiment of the invention.

To this end, the end 25*e* (FIG. 4) of the rod $\mathbf{21}_t$ may be accommodated in cavities 27*c* forcing the rod $\mathbf{21}_t$ to bend, as shown in detail in FIG. 4.

Figure 2C:
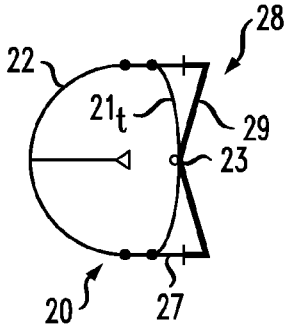

Depending on the embodiment, the rod $\mathbf{21}_t$ may be curved towards the reflector (FIG. 2*b*) or towards the protective surface 29 (FIG. 2*c*) of the radome 28 whilst, independently of that curvature, the protective surface may be connected to the rod $\mathbf{21}_t$ by one anchor point (FIG. 2*c*) or a plurality of anchor points (FIG. 2*b*) such as rings 23.

In another embodiment of the invention, the flexible surface 29 is curved by a deformation element fitted to the feeder device 26 of the antenna.

Figure 2D:
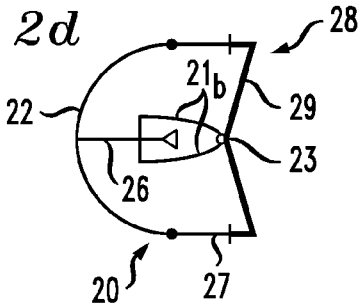

More precisely, the deformation element comprises two arms $\mathbf{21}_b$ fixed at one end to the waveguide 26 that transmit the electromagnetic waves received or transmitted by the subreflector of the antenna 20 and at their second end to attachment points 23 (FIG. 2*d*) or bearing points 23 (FIG. 2*e*) on the protective surface 29.

Figure 2E:
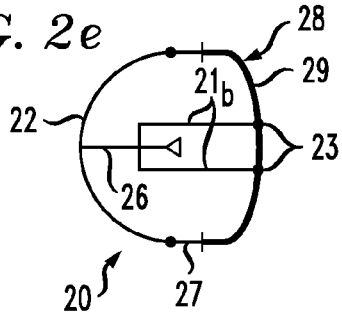

The invention therefore makes it easy to curve the protective surface 29 towards the reflector 22 (FIG. 2*d*) or towards the exterior of the antenna 20 (FIG. 2*e*).

Moreover, independently of whether the protective surface 29 is concave or convex, it is possible to vary the number of contact points 23 between the deformation element and the protective surface. Thus it is possible to use one bearing or attachment point (FIG. 2*d*) or a plurality of bearing or attachment points (FIG. 2*e*).

The present invention lends itself to numerous variants. Thus the deformation elements may be semi-rigid, such as springs. Moreover, the same embodiment may combine a plurality of different deformation elements, such as a rod $\mathbf{21}_t$ and stays $\mathbf{21}_h$.

Finally, it should be noted that, to limit the disturbances caused by the presence of the deformation element, the latter may be formed of a material that is relatively transparent to the electromagnetic waves transmitted by the antenna, such as fiberglass.

For example, a material formed by a polyester having a weight per unit area around 680 g/m$^2$ has the flexibility required to form radomes used in antennas according to the invention.

Thanks to a material of this kind, a radome of the same kind—same material and same thickness—can be used with antennas operating in different frequency bands, such as the following frequency bands in GHz:

(2.5-3.5), (3.4-3.6), (3.6-4.2), (4.4-5.0), (5.25-5.85), (5.725-5.85), (5.725-6.875), (5.925-6.425), (5.925-6.875), (6.425-7.125), (7.125-7.75), (7.125-8.5), (7.725-8.275), (7.75-8.5), (10.3-10.7), (10.5-10.7), (10.7-11.7), (12.2-13.25), (12.7-13.25), (14.2-15.35), (17.7-19.7), (21.2-23.6), (24.25-26.5), (26.3-28.5), (27.5-29.5), (29.5-31.5), (31.0-33.4), (37.0-39.5), (51.4-52.6) and (54.25-59.0).

The present invention lends itself to numerous variants. In fact, in the preferred embodiments described hereinabove the flexible radome is curved symmetrically with respect to an axis of the antenna defined as the axis of symmetry of the reflector of the antenna, this arrangement being particularly simple and quick to implement.

However, the invention may be implemented using an electromagnetic wave relaying device enabling the flexible radome to be fitted to a cylindrical lateral screen the axis whereof is not aligned with the axis of the reflector. In this case, the flexible radome may be curved symmetrically with respect to the axis of the cylinder formed by the screen to obtain the advantages referred to above and in particular in order to minimize noise generated by waves reflected by its protective surface.

The invention claimed is:

1. A radio communication antenna comprising a reflector fitted to a first opening of a cylindrical lateral screen and a radome formed by a flexible material covering a second opening of this lateral screen so as to have a protective surface facing the reflector, wherein the protective surface is curved by the mechanical action of a deformation element of the antenna coming into contact with this protective surface.

2. An antenna according to claim 1, wherein the protective surface is curved symmetrically with respect to an axis of symmetry of the reflector.

3. An antenna according to claim 1, wherein the mechanical action is exerted by at least one of the following elements: a rod, a stay or a spring.

4. An antenna according to claim 3, wherein the deformation element comprises a deformable rod fixed at both ends to the interior of the cylindrical lateral screen, the length of the rod being greater than the diameter of the screen so that the rod remains curved.

5. An antenna according to claim 1, wherein the deformation element curves the protective surface by application of a traction force to at least one anchor point on the protection surface.

6. An antenna according to claim 1, wherein the deformation element curves the protective surface by applying pressure to at least one bearing point on the protective surface.

7. An antenna according to claim 1, wherein the deformation element comprises a fixing to a feeder device of the antenna.

8. An antenna according to claim 7, wherein the deformation element comprises at least one arm one end whereof is fixed to a waveguide and the other end whereof comes into contact with the protective surface, the arm extending collinearly with an axis of symmetry of the reflector.

9. An antenna according to claim 1, wherein the protective surface has rigid portions.

10. A method of assembling a radio communication antenna comprising a reflector fitted to a first opening of a cylindrical lateral screen and a radome formed by a flexible material covering a second opening of this lateral screen so as to have a protective surface facing the reflector, the method comprising a step of assembling the antenna so that the protective surface is curved by the mechanical action of a deformation element of the antenna coming into contact with this protective surface.

11. A method according to claim 10, further comprising the step of curving the protective surface symmetrically with respect to an axis of symmetry of the reflector.

12. A method according to claim 10, further comprising the step of choosing the deformation element from a rod, a stay or a spring.

13. A method according to claim 10, further comprising the step of fixing a deformable rod to the interior of the lateral screen, the length of the rod being greater than the diameter of the screen so that the rod remains curved.

* * * * *

UNITED STATES PATENT AND TRADEMARK OFFICE

CERTIFICATE OF CORRECTION

PATENT NO. : 7,656,363 B2
APPLICATION NO. : 11/566951
DATED : February 2, 2010
INVENTOR(S) : Devicque et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 279 days.

Signed and Sealed this

Twenty-eighth Day of December, 2010

David J. Kappos

David J. Kappos
*Director of the United States Patent and Trademark Office*